United States Patent [19]

Le Maitre

[11] Patent Number: 4,569,304

[45] Date of Patent: Feb. 11, 1986

[54] COATING APPARATUS

[75] Inventor: Richard B. C. Le Maitre, Somerset West, South Africa

[73] Assignee: Aeci Limited, Johannesburg, South Africa

[21] Appl. No.: 637,557

[22] Filed: Aug. 3, 1984

[30] Foreign Application Priority Data

Aug. 9, 1983 [ZA] South Africa ..... 83/5844

[51] Int. Cl.[4] ..... B05C 11/04

[52] U.S. Cl. ..... 118/122; 118/419

[58] Field of Search ..... 118/121, 122, 419, 123, 118/126

[56] References Cited

U.S. PATENT DOCUMENTS

| | | | |
|---|---|---|---|
| 1,826,697 | 10/1931 | Charch et al. | 118/122 X |
| 2,444,262 | 6/1948 | Knight et al. | 118/122 X |
| 2,462,297 | 2/1949 | Adams | 118/419 X |
| 2,489,985 | 11/1949 | Speight, Jr. | 118/117 X |
| 3,190,263 | 6/1965 | Belak | 178/101 |
| 4,233,930 | 11/1980 | Wohlfeil | 118/122 |

FOREIGN PATENT DOCUMENTS

| | | | |
|---|---|---|---|
| 1906113 | 8/1974 | Fed. Rep. of Germany | 118/122 |
| 2825907 | 2/1981 | Fed. Rep. of Germany | 118/126 |

*Primary Examiner*—John P. McIntosh

*Attorney, Agent, or Firm*—Cushman, Darby & Cushman

[57] ABSTRACT

A hot knife coater comprises a pair of thicknesser blades defining between them a thicknesser gap through which a web to be coated passes. Each blade is connected to a downwardly depending mid-portion of a blade support by means of a number of longitudinally spaced blade holders. This minimizes bowing of the blade supports as a result of heat conducted to the blade supports from the respective blades. The blade holders connecting one of the blades to the respective blade support are adjustable so as to permit local adjustment, in the region of each blade holder, of the gap. Each blade support is mounted so as to be pivotal about a longitudinally extending pivot axis and is biased by a spring against a stop. This permits automatic opening of the gap to let a seam in the web through the gap, thus eliminating the need for operator intervention.

11 Claims, 9 Drawing Figures

COATING APPARATUS

FIELD OF THE INVENTION

THIS INVENTION relates to coating apparatus.

More particularly, the invention relates to coating apparatus of the kind comprising: means for applying a coating material in liquid or paste form to a continuous substrate web; means defining a thicknesser gap, at least one side of the gap being defined by a thicknesser blade; and means for guiding the web with coating material applied thereto through the thicknesser gap. The direction along the thicknesser gap is referred to herein as the longitudinal direction, the plane in which the web lies where it passes through the thicknesser gap as the web plane, and the plane in which the blades lie as the blade plane.

BACKGROUND TO THE INVENTION

In conventional coating apparatus of the kind described above, the thicknesser blade is strengthened mechanically by being secured along its entire length to a blade support. The connection between the blade and the blade support is along that portion of the blade support which is closest to the web plane. The blade needs to be strengthened mechanically in order to minimise bending of the blade in the blade plane, as a result of mechanical stresses during operation. It will be appreciated that bending of the blade in the blade plane would cause a variation in the width of the thicknesser gap and this is not wanted. However, the construction referred to above does lead to certain difficulties. First, the blade needs to be machined extremely accurately throughout its length in order to ensure a uniform gap width. Second, if the blade is used in a so-called hot knife coater, wherein the coating material is hot, that portion of the blade immediately adjacent the thicknesser gap heats up to about the temperature of the coating material, whereas that portion of the blade support remote from the blade remains at about room temperature. The temperature differential thus set up across the width of the blade assembly (i.e. the assembly of blade and blade support) causes the blade assembly to bend or bow in the blade plane despite the mechanical strength of the assembly in this plane. Even slight bending (e.g. with the blade having a radius of curvature in the order of 1 to 2 km) can cause defects in the material produced by the apparatus. The problem is aggravated by the fact that the coating material is usually applied to the web by passing the web through a bath of the material and that the bath is replenished with hot coating material at intermittent intervals and often at one point along the length of the bath. Thus, not only does the temperature of the blade vary along the length of the blade, it also fluctuates in time.

Another difficulty experienced with conventional coating apparatus of the kind described above is that when a seamed portion of the web is to pass through the thicknesser gap, the gap has to be opened up by operator intervention. Failure by the operator to take the necessary action can result in damage to large portions of the material produced by the apparatus.

It is an object of the present invention to overcome or at least alleviate the above difficulties.

SUMMARY OF THE INVENTION

According to a first aspect of the invention there is provided coating apparatus which comprises:

means for applying a coating material in liquid or paste form to a continuous substrate web;

means defining a thicknesser gap, at least one side of the gap being defined by a longitudinally extending thicknesser blade;

means for guiding the web, with coating material applied thereto, in a web plane through the gap;

a longitudinally extending blade support having a proximate portion near the web plane and a distal portion remote from the web plane; and a plurality of longitudinally spaced blade holders each connecting the blade to a region of the blade support between the proximate and distal portions.

Each blade holder may be adjustable independently of the other blade holders, so as to permit local adjustment, in the region of each respective blade holder, of the width of the thicknesser gap.

According to a second aspect of the invention there is provided coating apparatus which comprises:

means for applying a coating material in liquid or paste form to a continuous substrate web;

means defining a thicknesser gap, at least one side of the gap being defined by a longitudinally extending thicknesser blade;

means for guiding the web, with coating material applied thereto, in a web plane through the gap;

a longitudinally extending blade support; and a plurality of longitudinally spaced blade holders each connecting the blade to the blade support, each blade holder being adjustable, independently of the other blade holders, so as to permit local adjustment, in the region of each respective blade holder, of the width of the thicknesser gap.

Where the blade holders are adjustable they may each comprise:

a mounting bracket secured to the blade support;

a gripper element connected to the mounting bracket in such a manner as to be displaceable, with respect to the mounting bracket, towards or away from the web plane;

an adjustment element mounted on the mounting bracket so as to be rotatable with respect to the mounting bracket about a first axis of rotation; and a follower element mounted on the adjustment element so as to be rotatable with respect to the adjustment element about a second axis of rotation parallel to but displaced from the first axis of rotation, the follower element being connected to the gripper element so that, upon rotation of the adjustment element, the gripper element is displaced towards or away from the web plane;

the blade being secured to the gripper elements.

The coating apparatus may further comprise, at each end of the blade support, a carrier supporting the blade support, the blade support being mounted on the carriers so as to be pivotally displaceable with respect to the carriers about a longitudinally extending pivot axis spaced from the web plane;

a stop for limiting displacement of the blade support about said pivot axis in one direction beyond an operative position; and biasing means for biasing the blade support in said one direction towards the operative position.

According to a third aspect of the invention there is provided coating apparatus which comprises:

means for applying a coating material in liquid or paste form to a continuous substrate web;

means defining a thicknesser gap, at least one side of the gap being defined by a longitudinally extending thicknesser blade;

means for guiding the web, with coating material applied thereto, in a web plane through the gap;

a longitudinally extending blade support, the thicknesser blade being connected to the blade support; and at each end of the blade support, a carrier supporting the blade support, the blade support being mounted on the carriers so as to be pivotally displaceable with respect to the carriers about a longitudinally extending pivot axis spaced from the web plane;

a stop for limiting displacement of the blade support about said pivot axis in one direction beyond an operative position; and biasing means biasing the blade support in said one direction towards the operative position.

The carriers may be displaceable towards or away from the web plane.

Each carrier may comprise a carrier body and a cam member mounted on the carrier body, the blade support being mounted on the carriers via the respective cam members, each cam member being rotatable with respect to the respective carrier body about a third axis of rotation parallel to but spaced from the pivot axis.

The blade may have a thicknesser edge defining said thicknesser gap, a rear edge opposite the thicknesser edge, and a plurality of longitudinally spaced slots, each slot extending from the rear edge towards the thicknesser edge.

The invention will now be descried in more detail, by way of example, with reference to the accompanying drawings.

DETAILED DESCRIPTION OF PREFERRED EMBODIMENT

Figure 1:
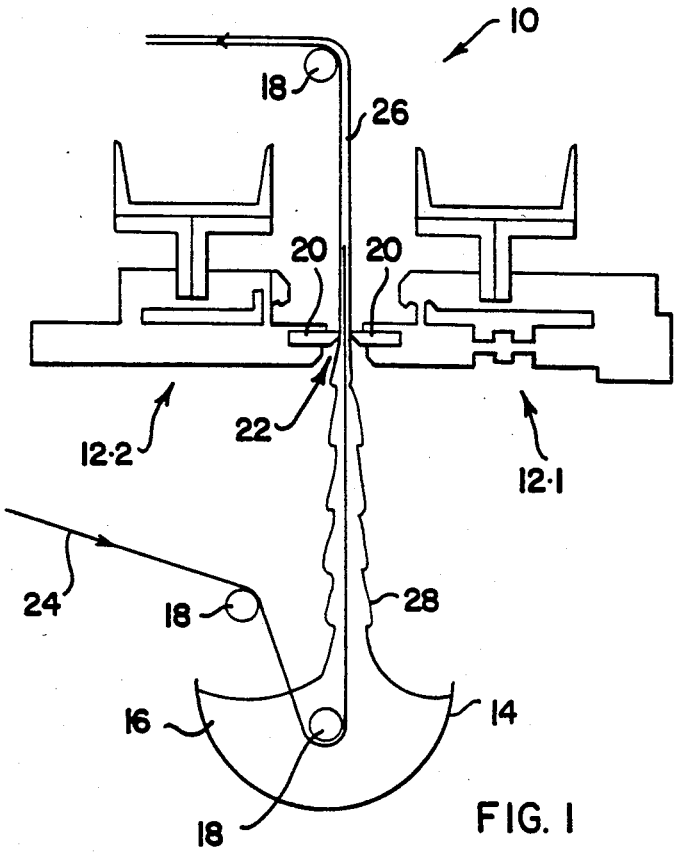
FIG. 1 is a diagrammatic drawing showing a vertical section of the operative parts of a hot knife coater according to the invention.

Referring first to FIG. 1, reference numeral 10 generally indicates a hot knife coater comprising a pair of blade assemblies 12.1 and 12.2, a receptacle 14 for containing a hot liquid or paste-like coating material 16, and guide rollers 18. Each blade assembly 12.1, 12.2 comprises a thicknesser blade 20, the two thicknesser blades 20 defining between them a thicknesser gap 22.

In use, a substrate web 24 is trained, by means of the guide rollers 18, through the coating material 16 in the receptacle 14, and from there upwardly through the thicknesser gap 22. In passing through the material 16 in the receptacle 14, the web picks up some of the material, and carries this with it to the thicknesser gap, where the thicknesser blades remove excess material and thereby determine the thickness of the resulting coated material 26. Reference numeral 28 indicates gravity flow-back of excess coating material.

The substrate web 24 can, for example, be a woven 'Nylon' fabric, whereas the coating material 16 can be a PVC paste.

Reference will now also be made to the remaining Figures.

Reference numeral 30 (FIG. 2), indicates a longitudinally extending thicknesser edge 30 defined by the thicknesser blade 20. The blade 20 has a series of longitudinally spaced slots or saw cuts 32 provided therein, the purpose of these being to reduce the ability of the blade 20 to resist bending in the plane of the blade, i.e. the horizontal plane. At the centre of the blade, as well as adjacent each notch or saw cut 32 there is a bolt hole 34. At the bottom of the blade, slightly set back from the edge 30, there is a downwardly depending drip rail 35.

Figure 3:
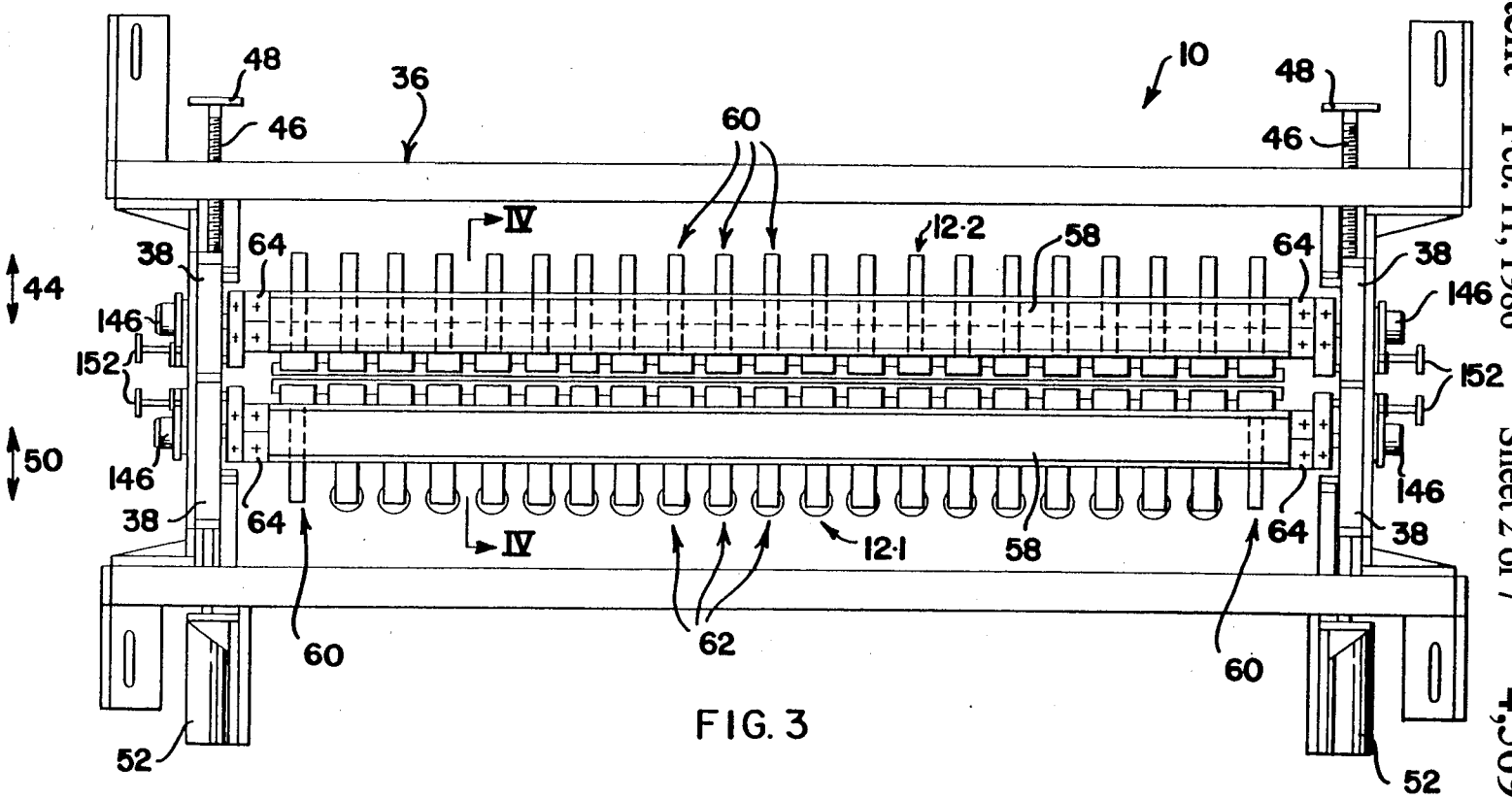
FIG. 3 is a plan view of the coater.
Figure 4:
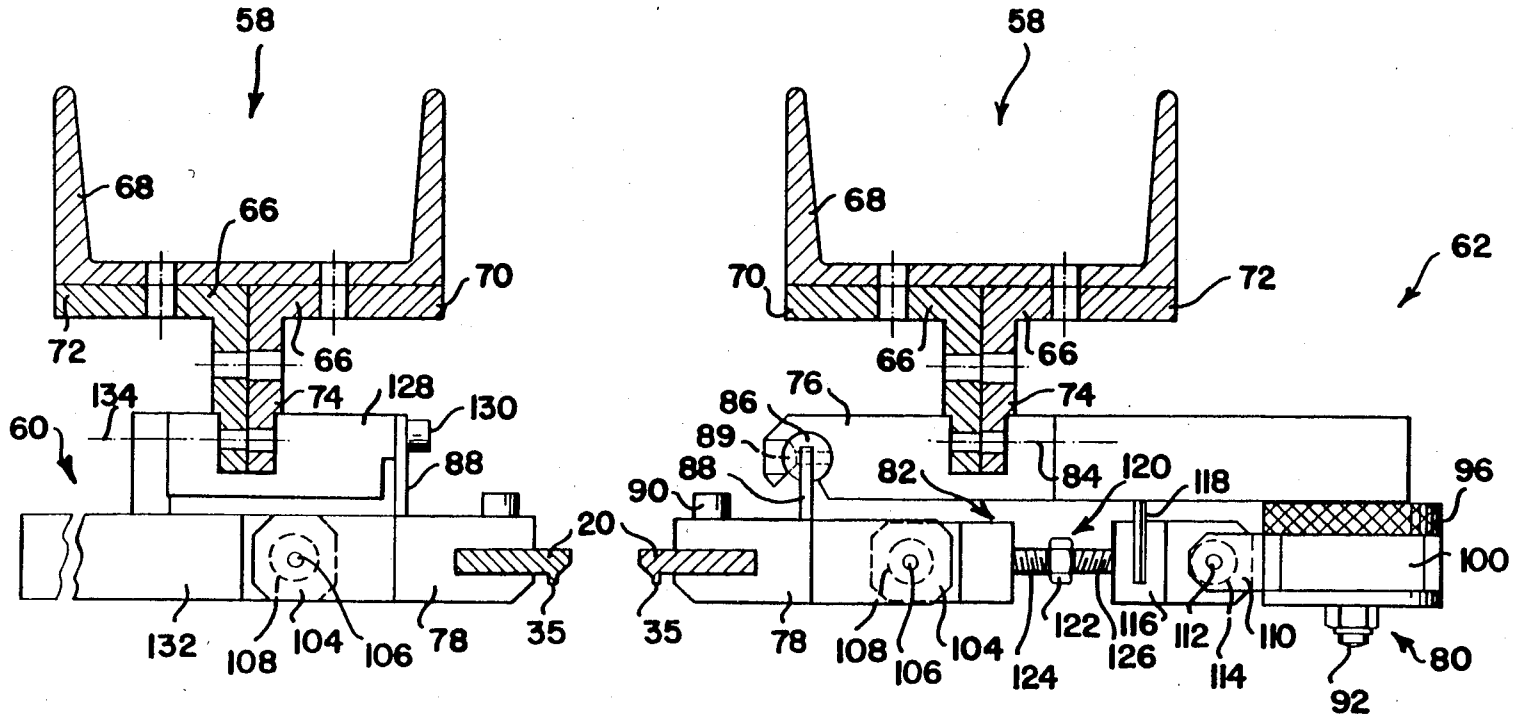
FIG. 4 is a vertical section of a pair of the blade assemblies forming part of the coater, taken on line IV—IV in FIG. 3.
Figure 6:
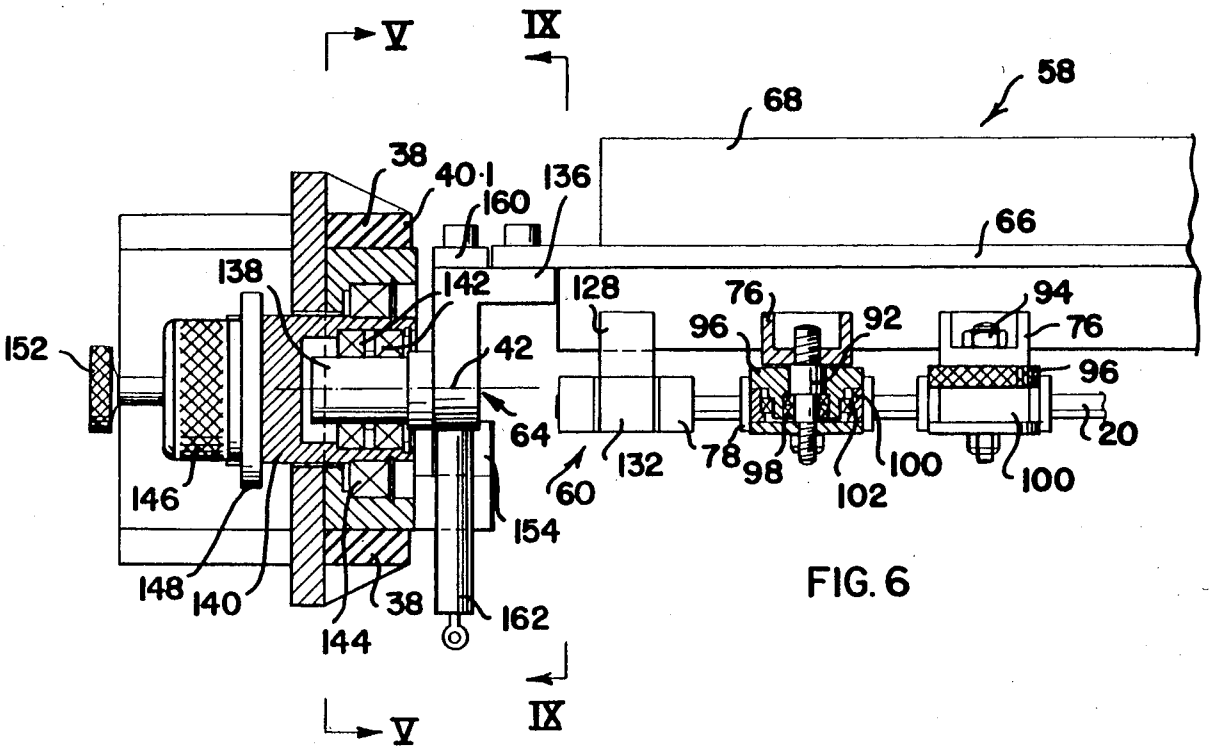
FIG. 6 is a rear elevation, drawn partly in section, of part of one of the blade assemblies and one of its carriers.
Figure 7:
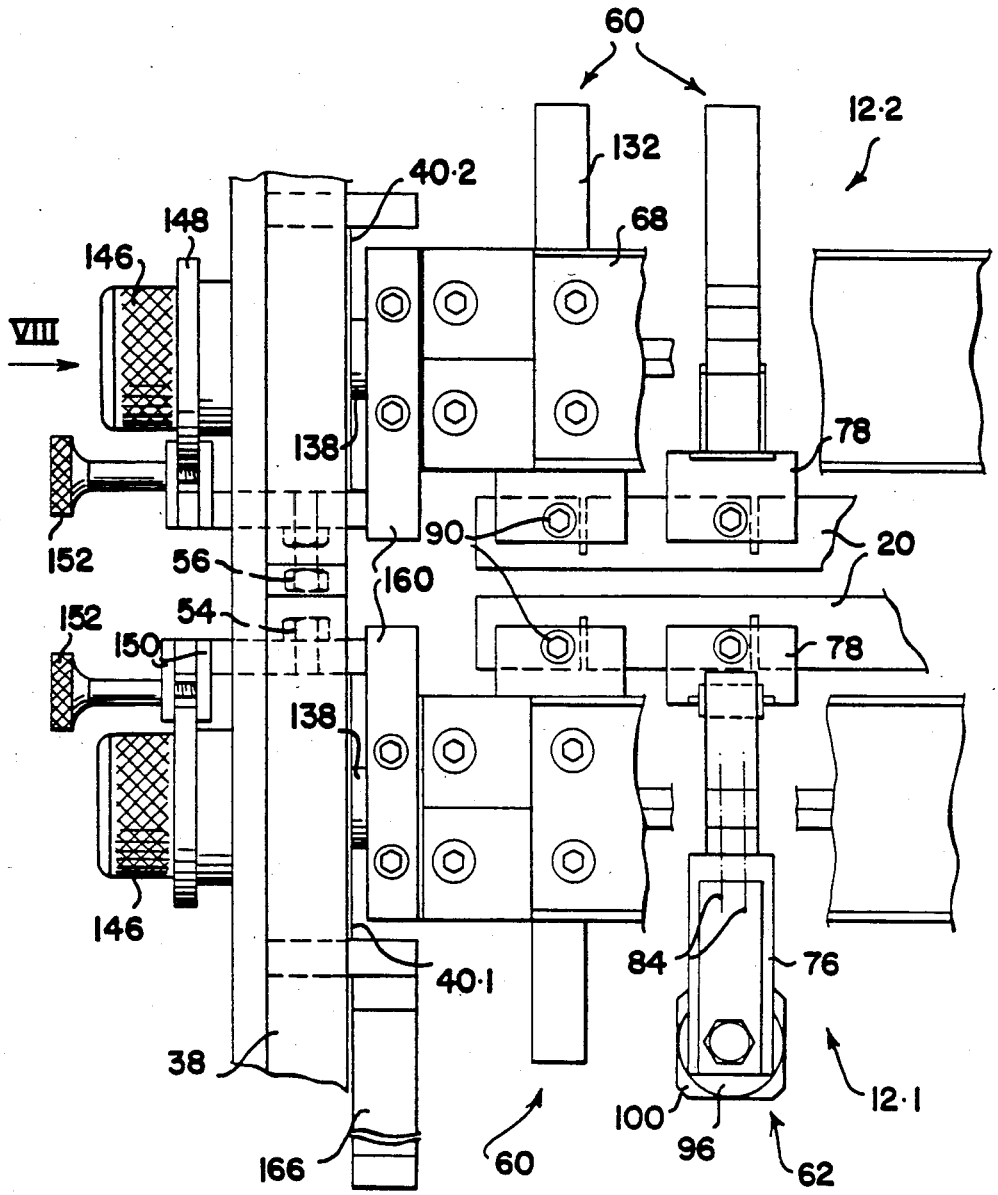
FIG. 7 is a plan view of part of the two blade assemblies.
Figure 8:
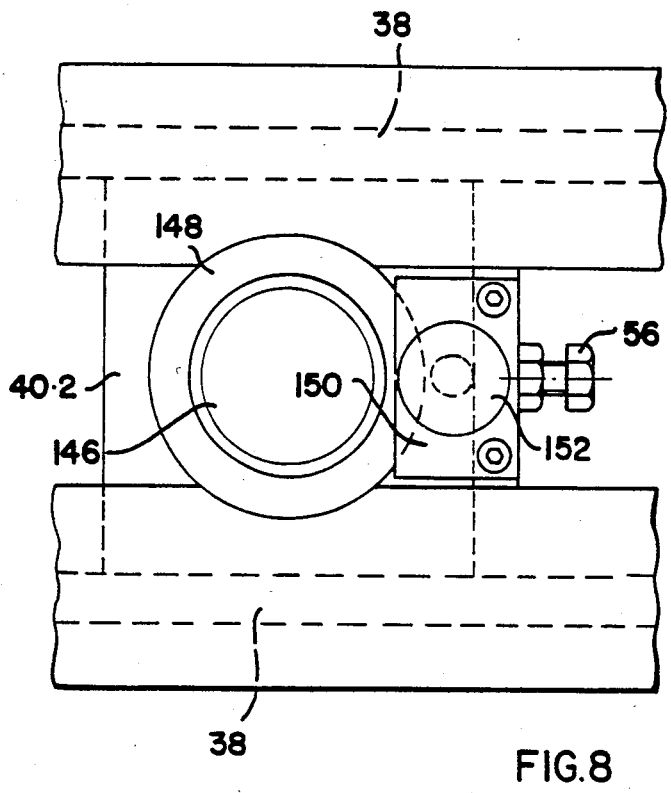
FIG. 8 is an end view as seen in the direction of arrow VIII in FIG. 7.
Figure 9:
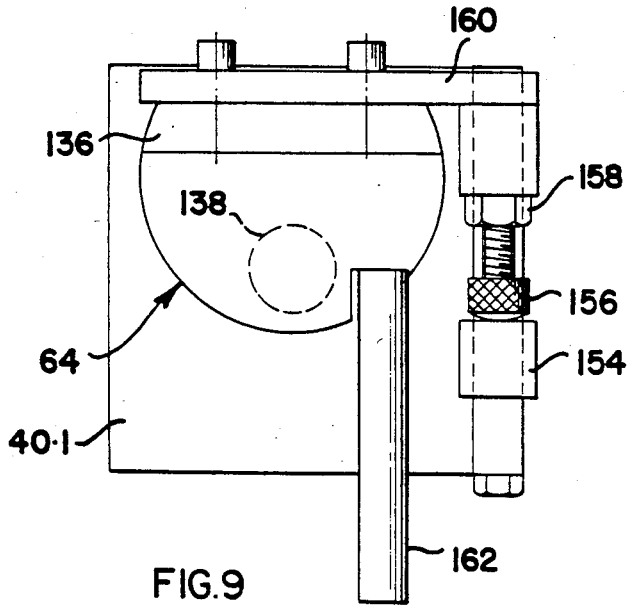
FIG. 9 is a view of part of one of the blade assemblies, seen in the direction of arrows IX—IX in FIG. 6.

The apparatus 10 comprises a framework support structure 36 (FIG. 3) which includes, at each end of the blade assemblies 12.1, 12.2, a horizontally extending pair of rails 38 (FIGS. 3, 6, and 7). Each pair of rails 38 slidably supports a pair of carriers 40.1, 40.2. The two carriers 40.1 (only one of which is shown) are associated wih the blade assembly 12.1, and the two carriers 40.2 (only one of which is shown) are associated with the blade assembly 12.2. Each blade assembly 12.1, 12.2 is mounted on the respective carriers 40.1, 40.2 so as to be pivotal about a pivot axis 42 in a manner which will hereinafter be described in more detail. The blade assembly 12.2 can be moved to and fro, in the direction of arrows 44, by means of a pair of lead screws 46 each provided with a hand-wheel 48. The blade assembly 12.2 can be moved to and fro, in the direction of arrows 50, by means of a pair of pneumatic cylinders 52.

Figure 5:
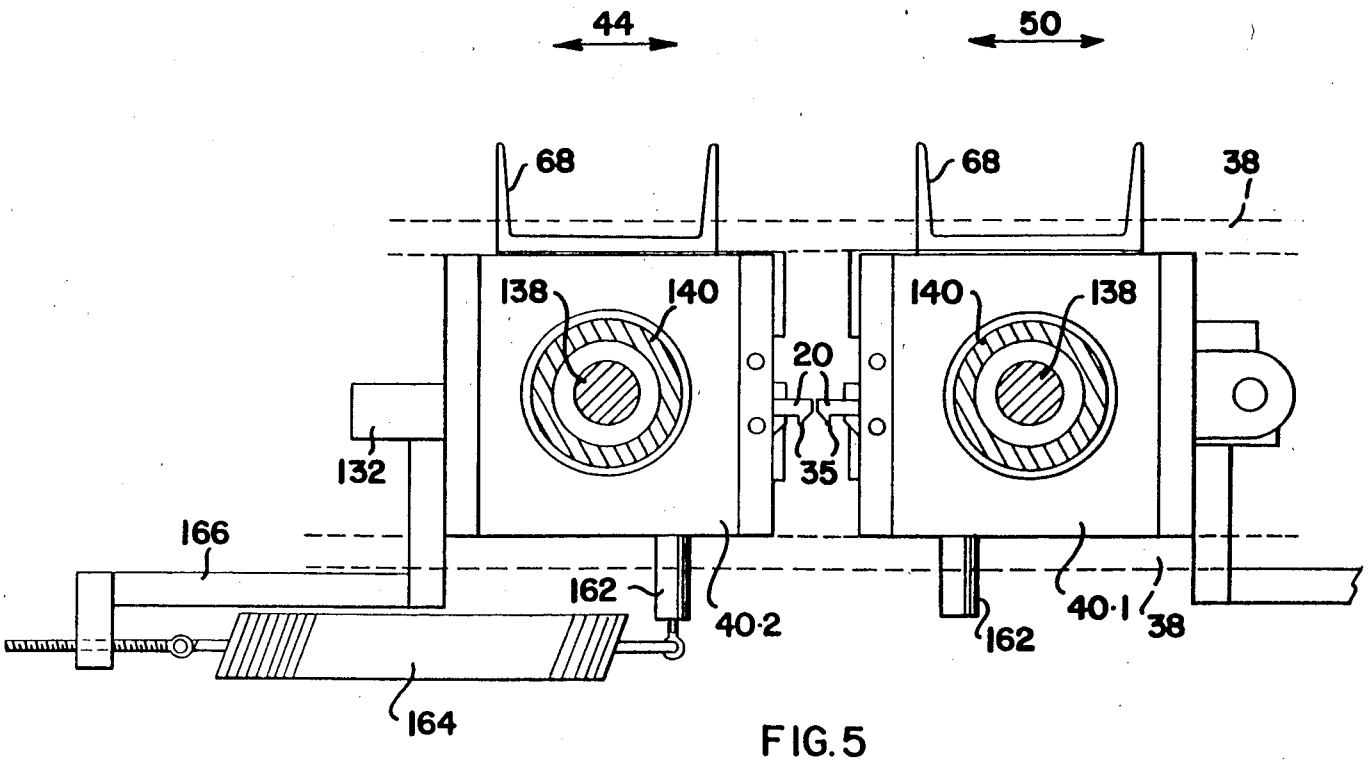
FIG. 5 is a cross section on line V—V in FIG. 6.

Movement of each pair of carriers 40.1, 40.2 towards one another is limited by means of an adjustable main stop, each main stop comprising a fixed bolt 54 which is fast with the carrier 40.1, and an adjustable bolt 56 which is fast with the carier 40.2. The hand-wheels 48 can be used to align the thicknesser gap 22 with the guide rollers 18, whereas the gap can be opened and closed by operating the pneumatic cylinders 52. When the gap is closed by the pneumatic cylinders 52, the carriers 40.1 move towards the carriers 40.2 until the heads of bolts 54 and 56 (omitted from FIG. 5) abut.

Each of the blade assemblies 12.1, 12.2 comprises, in addition to the thicknesser blade 20, a longitudinally extending blade support 58, a plurality of longitudinally spaced blade holders 60 and 62 which connect the thicknesser blade 20 to the blade support 58, and, at each end of the blade support, an end mounting 64. Each blade support 58 comprises a pair of angle sections 66 secured back-to-back, and a channel section 68 secured to the top of the angle sections 66. The blade holders 60 are non-adjustable, whereas the blade holders 62 are adjustable, as will be described in more detail hereinafter. In the blade asembly 12.1, the blade 20 is connected to the blade support 58 by a non-adjustable blade holder 60 at each end of the blade, and by a number of adjustable blade holders 62 between the ends of the blade. In the blade assembly 12.2, the blade 20 is connected to the blade support 58 by a number of non-adjustable blade holders 60.

Each blade support 58 comprises a proximate portion 70 which is relatively near the web plane, i.e. the plane in which the web lies as it passes through the thicknesser gap 22, a distal portion 72 which is relatively remote from the web plane, and a downwardly depending portion 74 between the proximate and distal portions.

Figure 2:
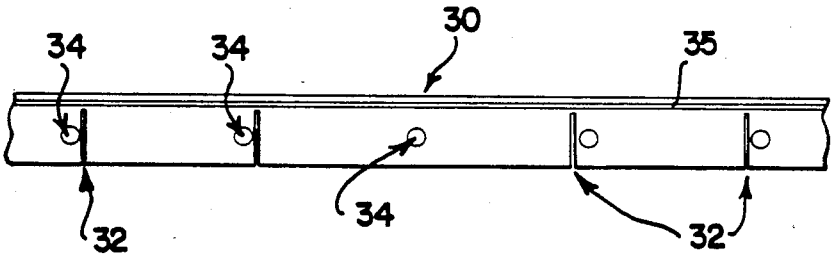
FIG. 2 is an underneath view of a central portion of one of the thicknesser blades forming part of the coater.

Each of the adjustable blade holders 62 comprises a mounting bracket 76, a gripper plate 78 at the front end of the mounting bracket, an eccentric adjuster 80 at the rear end of the mounting bracket, and an adjustable link 82 extending between the gripper plate and the eccentric adjuster. The blade holder 62 is secured to the downwardly depending portion 74 of the blade support 58 by means of bolts (not shown) at 84. The gripper plate 78 is secured to a cylinder 86 by means of a connector plate 88 and a screw 89, the cylinder fitting in a corresponding bore in the mounting bracket 76 so as to be pivotal and slidable in the bore. The gripper plate 78 is secured to the blade 20 by means of a bolt 90, the bolt passing through a corresponding one of the bolt holes 34 (FIG. 2).

The eccentric adjuster 80 comprises a spindle 92 which is secured to the mounting bracket 76 by means of a nut 94, a cam wheel 96 which is rotatable on the spindle 92 via a pair of ball bearings 98, and a cam follower 100 which is mounted for rotation on the cam wheel 96 via a ball bearing 102. The ball bearing 102 is eccentric with respect to the ball bearings 92. The cam wheel 96 has a knurled outer surface so as to facilitate adjustment of the eccentric adjuster.

The gripper plate 78 is connected to one end of the adjustable link 82 by way of a clevis 104, a pin 106, and a ball bearing 108. Similarly, the cam follower 100 is connected to the other end of the adjustable link 82 by way of a clevis 110, a pin 112, and a ball bearing 114. An end part 116 of the link 82, to which the clvis is connected, is in turn connected to the mounting bracket 76 by means of a pair of pins 118, only one of which is visible. A screw-threaded stud 120 is provided to adjust the length of the adjustable link 82. The stud 120 has a central hexagonal part 122, a right handed screw-thread 124 at one end of the stud, and a left-handed screw-thread 126 at the other end of the stud.

Each of the non-adjustable blade holders 60 comprises a mounting bracket 128, a gripper plate 78 secured to the mounting bracket by means of a connector plate 88 and a screw 130 (the parts 78 and 88 being identical to the corresponding parts of the adjustable blade holders 62), and a part 132 secured to the mounting bracket by a screw (not shown) at 134. As in the blade holder 62, there is a clevis 104, a pin 106, and a ball bearing 108 whereby the gripper plate 78 is connected to the part 132.

Each end mounting 64 comprises a bracket 136 to which the respective end of the blade support 58 is secured, the bracket carrying a stub shaft 138 which is co-axial with the pivot axis 42. The stub shaft 138 is rotatable in a cam member 140 via a pair of ball bearings 142, the cam member in turn being rotatable in the respective carrier 40.1 via a ball bearing 144. The ball bearing 144 is eccentric with respect to the ball bearing 142. The cam member 140 is provided with knurled portion 146 and a locking collar 148. A pair of lock plates 150 between which the locking collar 148 is engageable, and a knurled locking screw 152 are provided in order to lock the cam member 140 against rotation with respect to the carrier 40.1. The eccentricity of the two cam members 140 associated with the blade assembly 12.2 is in the order of 1000 micron, whereas the eccentricity of the two cam members 140 associated with the blade assembly 12.2 is in the order of 50 micron.

With each of the end mountings 64 there is associated a subsidiary stop, the subsidiary stop comprising a fixed rest 154 which is secured to the respective carrier 40.1, 40.2, and an adjustable screw 156 with a lock nut 158 which is adjustably secured to the respective bracket 136 via an arm 160. Each of the end mountings is provided with a stem 162 to which there is secured one end of a coil spring 164, the coil spring tending to keep the adjustable screw 156 in abutting engagement with the fixed rest 154. The other end of the coil spring 164 is connected to a spring support bracket 166 which is fast with the corresponding carrier 40.1, 40.2.

The coating apparatus 10 is set up as follows. First of all, as indicated above, the thicknesser gap 22 is brought into alignment with the guide rollers 18 by adjustment of the hand wheels 48 and the adjustable bolts 56. Thereafter the blade 20 of the blade assembly 12.1 is adjusted by individually adjusting each of the blade holders 62. In the apparatus illustrated, there are 21 blade holders for each of the blades. It will, however, be appreciated that any suitable number of blade holders may be used. Coarse adjustment of each of the blade holders 62 is effected by means of the screw-threaded stud 120, whereas fine adjustment is effected by means of the eccentric adjuster 80. Such adjustment will cause the gripper plate 78 to swivel slightly about the axis of the respective cylinder 86.

The width of the thicknesser gap 22 as a whole can be adjusted coarsely by adjusting the 1000 micron cams on the blade assembly 12.1, whereas fine adjustment of the thicknesser gap as a whole can be effected by means of the 50 micron cams on the blade assembly 12.2.

The coating apparatus herein described has the following advantages:

1. The PVC paste 16 which is used to coat the web 24 is hot so that it will cause the thicknesser blades 20 to heat up. The provision of the slots or saw cuts 32 will reduce to insignificant proportions any tendency for the blades to bow about the vertical as a result of the temperature differential between the front or thicknesser edge and the rear edge. Any heat which finds its way from the blade 20 to the blade support 58 has to flow via the downwardly depending portion 74. As the portion 74 is arranged midway between the proximate and distal portions 70 and 72 respectively, this heat will tend to increase the temperature of these two portions to an equal extent, thus minimising any bowing of the blade support as a result of temperature differentials. Heat which flows to the link 82 will tend to increase the length of this link and thus distort the setting. The pin and ball bearing connections 106, 108, 112 and 114, however, have a low heat conductivity, so that this increase in length is minimal. Furthermore, this effect is at least partly compensated for by an increase in the length of the mounting bracket 76 as a result of heat flowing from the blade into this bracket. The total effect on the blade 20 has been found to be negligible.

2. In view of the fact that one of the blades 20 can be adjusted throughout its length after having been installed, it is no longer necessary for the blades to be accurately machined. Any inaccuracy in machining can be compensated for by suitable adjustment after the blades have been installed.

3. Should there be a seam or other imperfection in the web 24, this will simply lift up one of the blades 20 by pivoting of the blade assembly about its pivot axis 42, without any operator intervention being required. In order to facilitate this action, the two coil springs 164 on one of the blade assemblies are adjusted to as to be less tight than the coil springs on the other blade assembly. Accordingly, when a seam or other imperfection reaches the blades 20, the blade which is associated with the less tightly set springs will simply lift up against the bias of the springs, and allow the seam to pass, whereafter the bias of the springs will again pull the respective blade downwardly until the stops 154, 156 abut. The coil springs 164 associated with the other blade assembly will allow that blade assembly to be lifted for maintenance and cleaning purposes.

I claim:

1. Coating apparatus which comprises:

means for applying a hot coating material in liquid or paste form to a continuous substrate web;

means defining a thicknesser gap, at least one side of the gap being defined by a longitudinally extending thicknesser blade;

means for guiding the web, with hot coating material applied thereto, in a web plane through the gap;

a longitudinally extending blade support having a proximate portion near the web plane and a distal portion remote from the web plane; and a plurality of longitudinally spaced blade holders each connecting the blade to a region of the blade support between the proximate and distal portions in such a manner that, in use, flow of heat from the hot coating material to the blade support via the thicknesser blade and the blade holders heat up the proximate and distal portions to substantially the same extent.

2. Coating apparatus according to claim 1, wherein there are three or more of said blade holders and wherein each blade holder is adjustable independently of the other blade holders, so as to permit local adjustment, in the region of each respective blade holder, of the width of the thicknesser gap.

3. Coating apparatus as claimed in claim 2, wherein each blade holder comprises:

a mounting bracket secured to the blade support;

a gripper element connected to the mounting bracket in such a manner as to be displaceable, with respect to the mounting bracket, towards or away from the web plane;

an adjustment element mounted on the mounting bracket so as to be rotatable with respect to the mounting bracket about a first axis of rotation; and a follower element mounted on the adjustment element so as to be rotatable with respect to the adjustment element about a second axis of rotation parallel to but displaced from the first axis of rotation, the follower element being connected to the gripper element so that, upon rotation of the adjustment element, the gripper element is displaced towards or away from the web plane;

the blade being secured to the gripper elements.

4. Coating apparatus according to claim 1, which further comprises, at each end of the blade support, a carrier supporting the blade support, the blade support being mounted on the carriers so as to be pivotally displaceable with respect to the carriers about a longitudinally extending pivot axis spaced from the web plane;

a stop for limiting displacement of the blade support about said pivot axis in one direction beyond an operative position; and biasing means for biasing the blade support in said one direction towards the operative position.

5. Coating apparatus according to claim 4, wherein the carriers are displaceable towards or away from the web plane.

6. Coating apparatus according to claim 5, wherein each carrier comprises a carrier body and a cam member mounted on the carrier body, the blade support being mounted on the carriers via the respective cam members, each cam member being rotatable with respect to the respective carrier body about a third axis of rotation parallel to but spaced from the pivot axis.

7. Coating apparatus which comprises:

means for applying a coating material in liquid or paste form to a continuous substrate web;

means defining a thicknesser gap, at least one side of the gap being defined by a longitudinally extending thicknesser blade;

means for guiding the web, with coating material applied thereto, in a web plane through the gap;

a longitudinally extending blade support; and three or more longitudinally spaced blade holders each connecting the blade to the blade support, each blade holder being adjustable, independently of the other blade holders, so as to permit local adjustment, in the region of each respective blade holder, of the width of the thicknesser gap, each blade holder comprising:

a mounting bracket secured to the blade support;

a gripper element connected to the mounting bracket in such a manner as to be displaceable, with respect to the mounting bracket, towards or away from the web plane;

an adjustment element mounted on the mounting bracket so as to be rotatable with respect to the mounting bracket about a first axis of rotation; and a follower element mounted on the adjustment element so as to be rotatable with respect to the adjustment element about a second axis of rotation parallel to but displaced from the first axis of rotation, the follower element being connected to the gripper element so that, upon rotation of the adjustment element, the gripper element is displaced towards or away from the web plane;

the blade being secured to the gripper elements.

8. Coating apparatus according to claim 1 or claim 7, wherein the blade has a thicknesser edge defining said thicknesser gap, a rear edge opposite the thicknesser edge, and a plurality of longitudinally spaced slots, each slot extending from the rear edge towards the thicknesser edge.

9. Coating apparatus which comprises:

means for applying a coating material in liquid or paste form to a continuous substrate web;

means defining a thicknesser gap, at least one side of the gap being defined by a longitudinally extending thicknesser blade;

means for guiding the web, with coating material applied thereto, in a web plane through the gap;

a longitudinally extending blade support, the thicknesser blade being connected to the blade support; and at each end of the blade support, a carrier supporting the blade support, the blade support being mounted on the carriers so as to be pivotally displaceable with respect to the carriers about a longitudinally extending pivot axis spaced from the web plane;

a stop for limiting displacement of the blade support about said pivot axis in one direction beyond an operative position; and biasing means biasing the blade support in said one direction towards the operative position.

10. Coating apparatus according to claim 9, wherein the carriers are displaceable towards or away from the web plane.

11. Coating apparatus according to claim 9, wherein each carrier comprises a carrier body and a cam member mounted on the carrier body, the blade support being mounted on the carriers via the respective cam members, each cam member being rotatable with respect to the respective carrier body about a third axis of rotation parallel to but spaced from the pivot axis.

* * * * *